United States Patent [19]

Lincoln et al.

[11] Patent Number: 5,073,120

[45] Date of Patent: Dec. 17, 1991

[54] POWER DISTRIBUTION UNIT

[75] Inventors: Frank Lincoln, Dunwoody, Ga.; Victor Slack, Lewisville, N.C.

[73] Assignee: AMP Incorporated, Harrisburg, Pa.

[21] Appl. No.: 645,954

[22] Filed: Jan. 25, 1991

[51] Int. Cl.[5] ..... H01R 4/66

[52] U.S. Cl. ..... 439/92; 439/215

[58] Field of Search ..... 439/92, 95, 215, 680

[56] References Cited

U.S. PATENT DOCUMENTS

| | | | |
|---|---|---|---|
| 4,313,646 | 2/1982 | Millhimes et al. | 439/680 X |
| 4,399,371 | 8/1983 | Ziff et al. | 439/95 X |
| 4,740,167 | 4/1988 | Millhimes et al. | 439/92 |

*Primary Examiner*—Eugene F. Desmond

*Attorney, Agent, or Firm*—Bruce Wolstoncroft

[57] ABSTRACT

A power distribution assembly is disclosed having a bussing distribution connector having a plurality of electrical bussing terminals positioned within an electrically insulative housing. A plurality of electrical terminals are positioned in the housing for distributing more than one electrical circuit; at least one ground terminal, at least one neutral terminal and at least three hot terminals. A grounding shell at least partially surrounds the bussing connector and includes a grounding tab grounding the one ground terminal to the metallic grounding shell. In another embodiment, two bussing connectors are interconnected together, to provide for an increased number of output ports.

18 Claims, 13 Drawing Sheets

122
116
112
126
8
132
130
120
138
131
138
118
10d
10c
124
124
4
110
72
66
10b
10a
114
140
135
144
146
142
144
140
136
142
144
146

Fig. 10
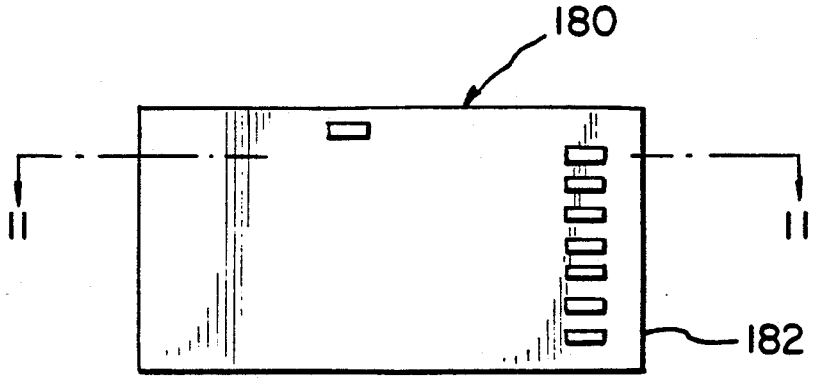
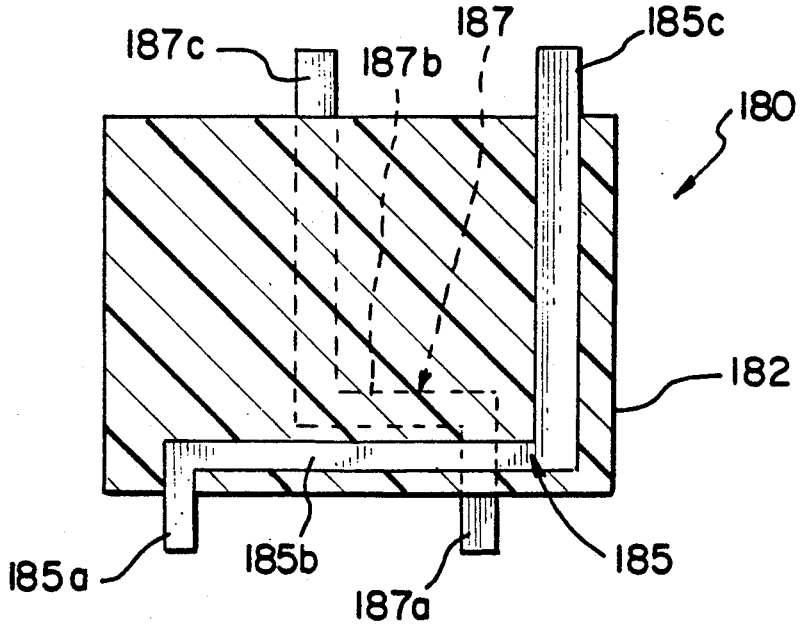
Fig. 11

POWER DISTRIBUTION UNIT

BACKGROUND OF THE INVENTION

1. Field of the Invention

This invention relates to power distribution units or assemblies of the type used in the wiring systems for buildings and particularly to a distribution unit which can receive a power source and redistribute the source power in three or more distributed circuits.

2. Description of the Prior Art

It is now common practice to provide electrical services to buildings by means of wiring systems of the type described in U.S. Pat. No. 4,740,167, incorporated herein by reference. Wiring systems of the type described in that patent specification comprise electrical cables having connectors on their ends, junction boxes, and duplex receptacles which are plugged into the junction boxes. The junction boxes contain a plurality of bus bars which are connected to the conductors in the cable when the connectors on the cable ends are coupled to the junction boxes. The bus bars in turn have integral receptacles for tab terminals so that when the duplex receptacles are plugged into the junction box, the bus bars are connected to the outlet receptacles in the duplex receptacles. It is common practice to use these receptacles in modular offices, mounting these junction boxes in walls or panels, in particular, in cutout openings within sheet metal walls. The wiring interconnecting these junction boxes is generally electrical power cable, surrounded by a metal conduit, and electrically interconnected to an electrical power connector.

This type of electrical cable, so-called pre-wired cable, is also useful in ceiling electrical systems for powering the lights, for electrical distribution within environmental air areas, or for electrical distribution in raised floor systems. One of the shortcomings of this type of system is the distribution of branch circuits from a single source circuit. Many of these type wiring circuits are hard wired, spliced together by way of plastic "wire nuts" which screw down over three base conductors to common them together. However, U.L. does not recommend more than 3 wires to be so commoned, as the fourth would be trapped only by the round surfaces of the other three, making the electrical connection of the fourth questionable.

It is an object of the invention then to provide an electrical power distribution unit having easy electrical connection and disconnection thereof.

It is a further object of the invention to provide an electrical power distribution unit for use with three or four branch circuits from a common source.

It is a further object of the invention to provide an electrical power distribution unit capable of distributing more than one complete circuit to prevent overloading any one circuit.

Other objects and advantages of the invention will be apparent from the following description, the accompanying drawings and the appended claims.

SUMMARY OF THE INVENTION

The objects of the invention were accomplished by providing a power distribution unit comprising bussing connection means having insulating housing means having side walls and end walls, where at least one of the end walls comprises through ports and where at least one of the end walls comprises through ports and where the member has a plurality of internal side-by-side channels. Each channel is in communication with at least two through ports, and at least one of the side walls includes an opening therethrough in communication with one of the channels. A plurality of electrical power busses are positioned in the channels, the busses comprising at least one ground bus, one neutral bus being aligned with the opening in the one channel, the busses each comprising at least two electrical terminals extending from ends of the busses and insulatively positioned in at least two through ports for further distribution of power. A grounding shell means is at least partially surrounding the housing, leaving the through ports exposed, the grounding shell means comprising a slot therethrough aligned with the opening and the ground terminal. A grounding tab is positioned through the slot and electrically connected to the ground bus and electrically secured to the grounding shell, thereby grounding the ground terminal to the grounding shell means.

In this manner, the through ports can be used for the distribution of electrical power, and the system is electrically grounded, by way of the grounding tab, to the metallic housing.

BRIEF DESCRIPTION OF THE DRAWINGS

FIG. 3 is a perspective view showing the parts of the junction box, except the bus bars, exploded from each other.

FIG. 5 is a sectional side view showing the two parts of the junction box housing in aligned spaced apart relationship and showing a bus bar in one of the housing parts.

FIG. 10 is a side view of the jumper connector shown in FIG. 9.

FIG. 11 is a cross-sectional view through lines 11—11 of FIG. 10.

FIG. 13 is a further embodiment of a jumper connector for use with the embodiment of FIG. 9.

THE PREFERRED EMBODIMENT OF THE INVENTION

Figure 1:
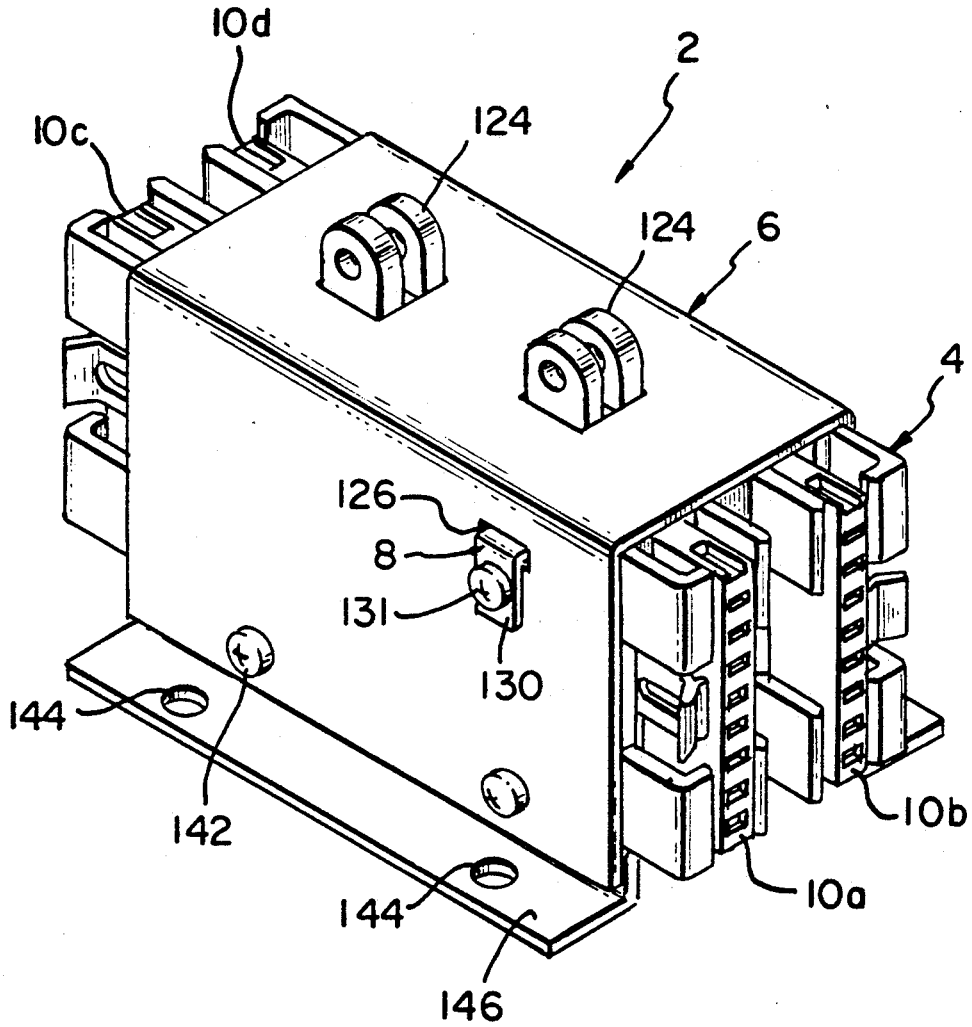
FIG. 1 is an isometric view of the power distribution unit of the subject invention.
Figure 2:
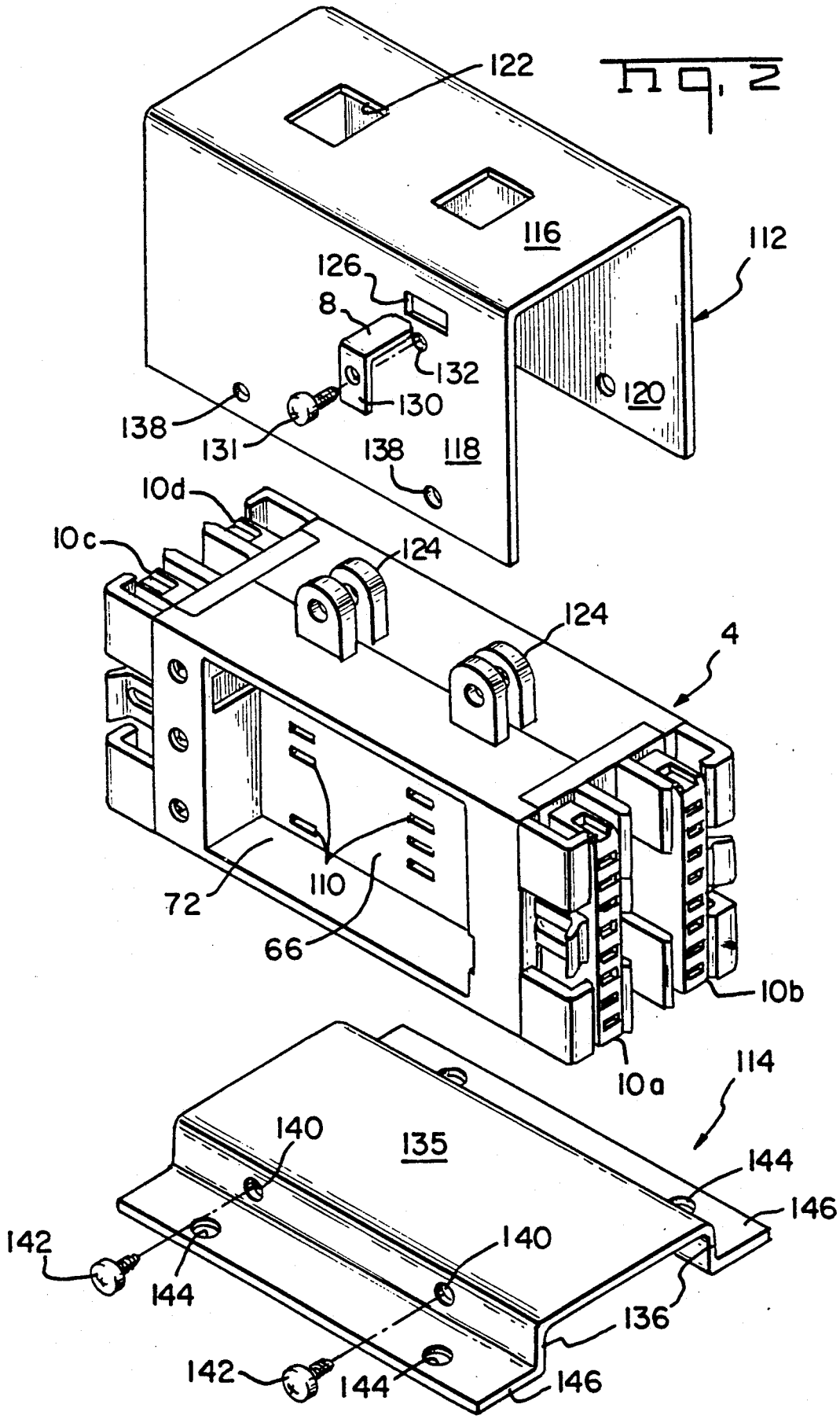
FIG. 2 is a view, similar to that of FIG. 1, showing the components of the power distribution unit exploded away from each other.

FIGS. 1 and 2 show a power distribution assembly 2 comprising an inner electrical bussing connector member 4 and an outer metallic grounding shell 6, at least partially surrounding the connector member 4. The connector member 4 is grounded to the shell 6 by an electrical tab 8 secured to the metallic shell 6 and electrically connected to a ground terminal of the electrical bussing connector, as will be described herein. The power distribution assembly 2 further comprises electrical ports 10*a*–10*d* at the ends of the connector member 4, where one of the ports can be used as a power supply, while the remainder of the ports may be used as receptacles for branch circuits for the further distribution of power.

Figure 4:
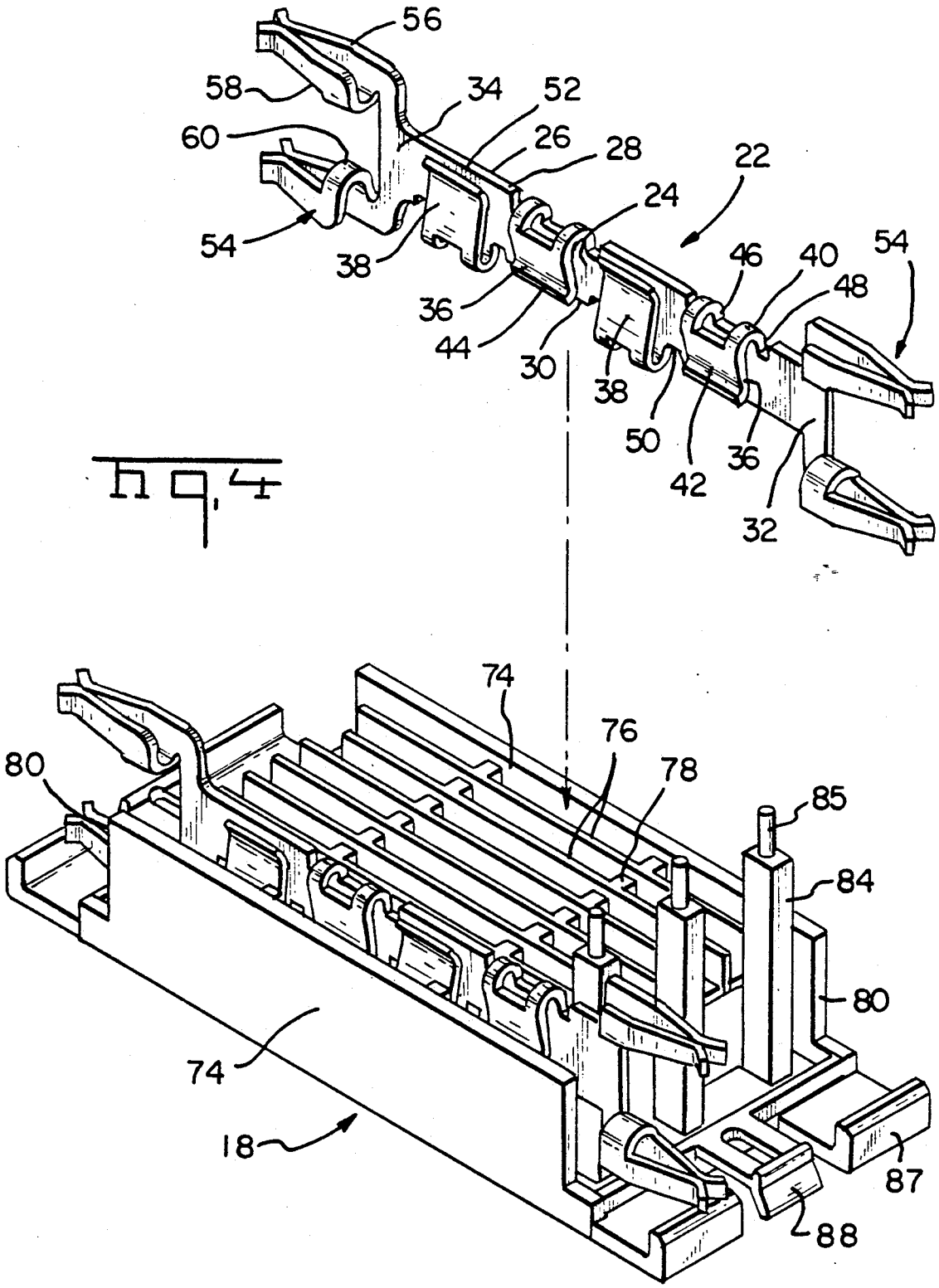
FIG. 4 is a view showing one of the sections of the junction box housing with a bus bar exploded from the housing.
Figure 7:
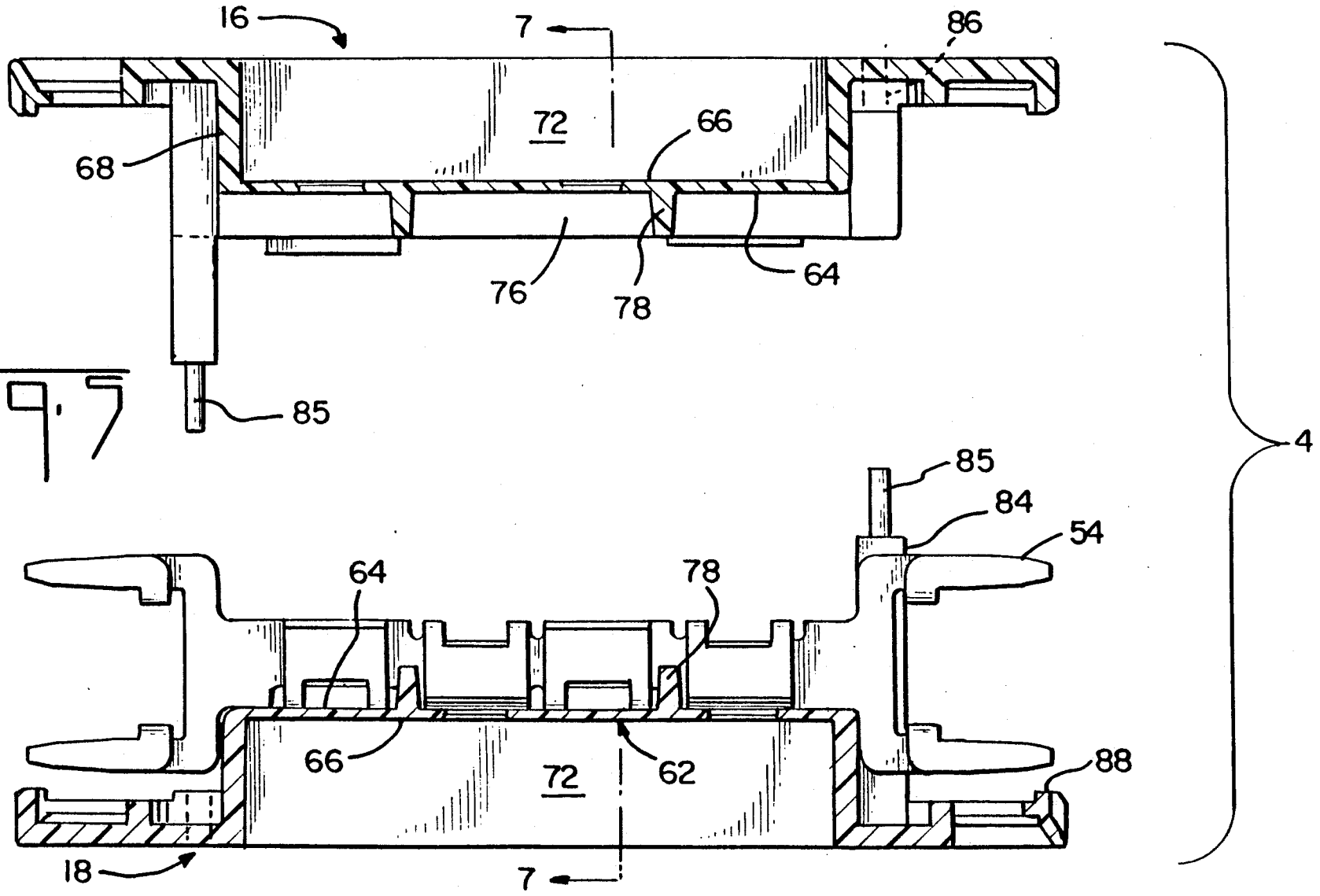

With reference now to FIGS. 3–7, the bussing connector 4 will be described in greater detail, although the connector is substantially similar to that shown and described in U.S. Pat. No. 5,015,203, incorporated herein by reference. The bussing connector 4 is composed of two housing parts 16,18 two end caps 20, and eight bus bars 22 (FIG. 4). As shown in FIG. 4, the bus bars are stamped and formed sheet metal members, each of which has first and second side surfaces 24,26, first and second edges 28,30 and ends 32,34.

Two ears 36 extend from the first side edge 28, while two ears 38 extend from the second side edge 30, all of the ears extending laterally across the first side surface 24 with alternating ears projecting in opposite directions. That is, the ears are staggered so that the two ears 38 extend upwardly while the two ears 36 project downwardly, as viewed in FIG. 4. Each ear is reversely bent adjacent to its associated side edge to form a bight 40, an intermediate portion 42 which extends obliquely towards the side surface, and a free end 44. Each ear is bent adjacent to its free end so that the free end 44 extends obliquely away from the side surface thereby to provide lead-in surface portions for a terminal tab as will be described below.

Each ear has an opening 46 in its bight 40 and notches 48,50 on each side of the bight, the notches 48 being in the first edge 28 and the notches 50 being in the side edge 30. The openings 46 and the notches 48,50 are provided for the purpose of controlling the spring characteristics of the ears.

Figure 6:
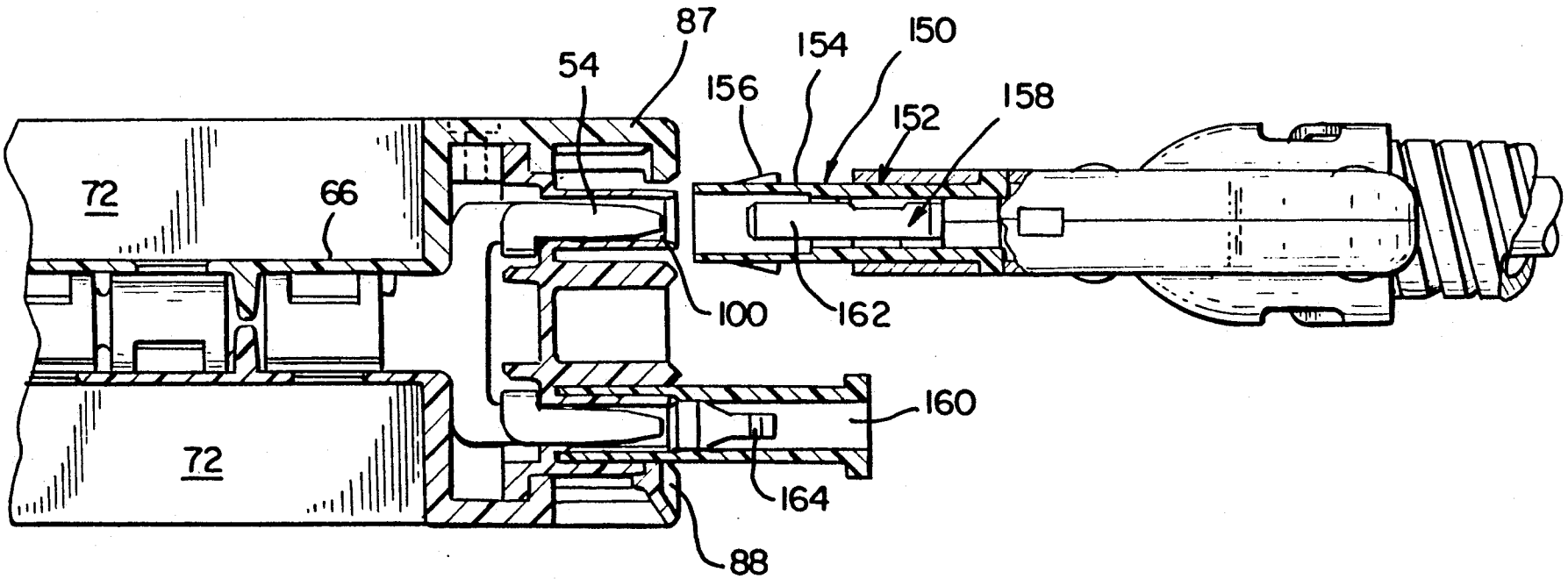
FIG. 6 is a view similar to FIG. 5 but showing the housing parts assembled to each other and an electrical connector mated to at least one power distribution port.
Figure 7:
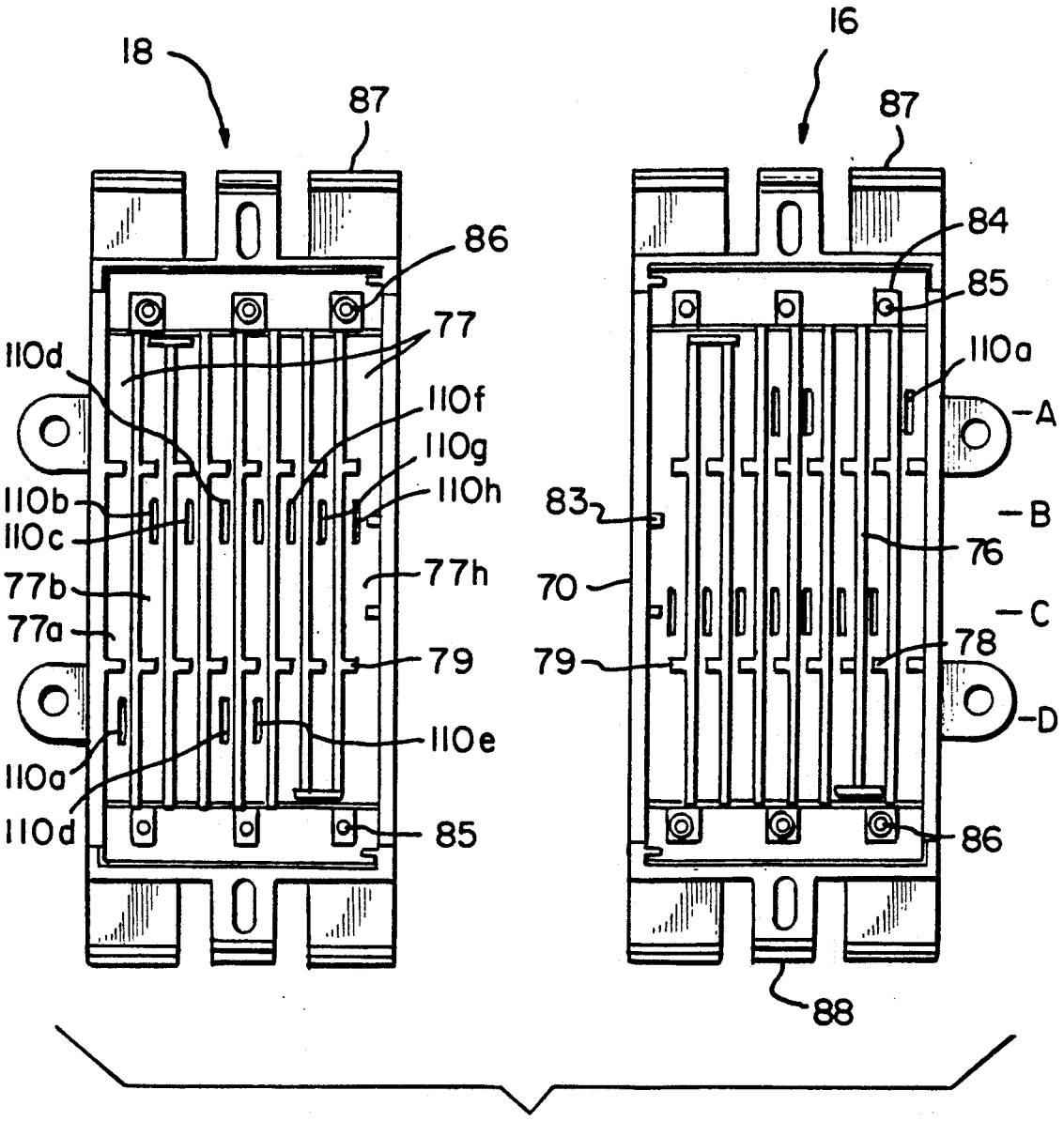

Each receptacle has a terminal receiving end 52 at the free end of its ear. As shown in FIG. 6, a tab terminal can be coupled to the receptacle by moving the tab into the space between the ear and the adjacent surface portions of the side wall 24. It will thus be apparent that each bus bar is capable of receiving two terminal tabs on its upper or first side edge 28 and two terminal tabs on its lower side edge 30 and all of these entrance portions 52 for the terminal tabs are in predetermined locations on the bus bar.

Each bus bar has two additional receptacles 54 extending from each of its ends 32,34. Each of these additional receptacles comprises coextensive and convergent arms 56,58 which are connected to each other by a folded section 60. These additional receptacles receive tab terminals of electrical connectors as described herein.

Figure 7:
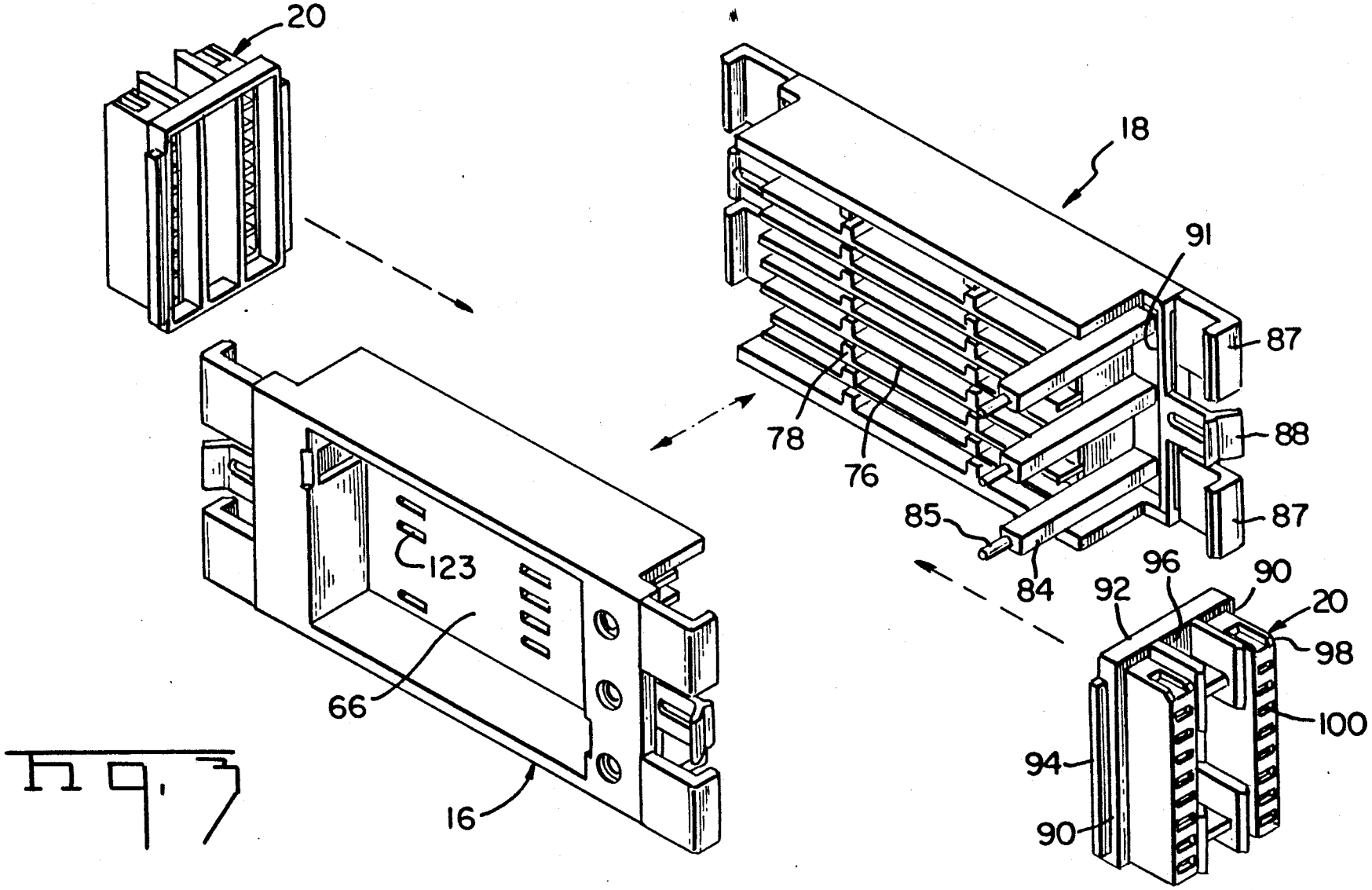
FIG. 7 is a top plan view of the internal surfaces of the junction box sections.

The two junction box housing parts 16,18 are identical and the same reference numerals will therefore be used to identify corresponding structural parts of the housing sections. Referring to FIGS. 4 and 5, each housing part comprises a rectangular panel 62 having an internal surface 64 and an external surface 66. End walls 68 and side walls 70 surround the external surface 66 so as to define a recess 72. As shown in FIG. 4, side wall portions 74 extend beyond the internal surface 64 of the panel and a plurality of parallel barrier walls 76 extend between the ends of the housing part The barrier walls 76 and the portions 74 of the side walls define side-by-side stalls 77 for the bus bars 22, as shown in FIG. 7. Ribs 78 extend laterally from the barrier walls, and as shown in FIGS. 7 and 9, the ribs have ends 79 which are spaced from the surface of the next adjacent barrier wall 76 by a distance which is slightly greater than the thickness of a bus bar as measured between the bus bar side surfaces 24,26.

Figure 9:
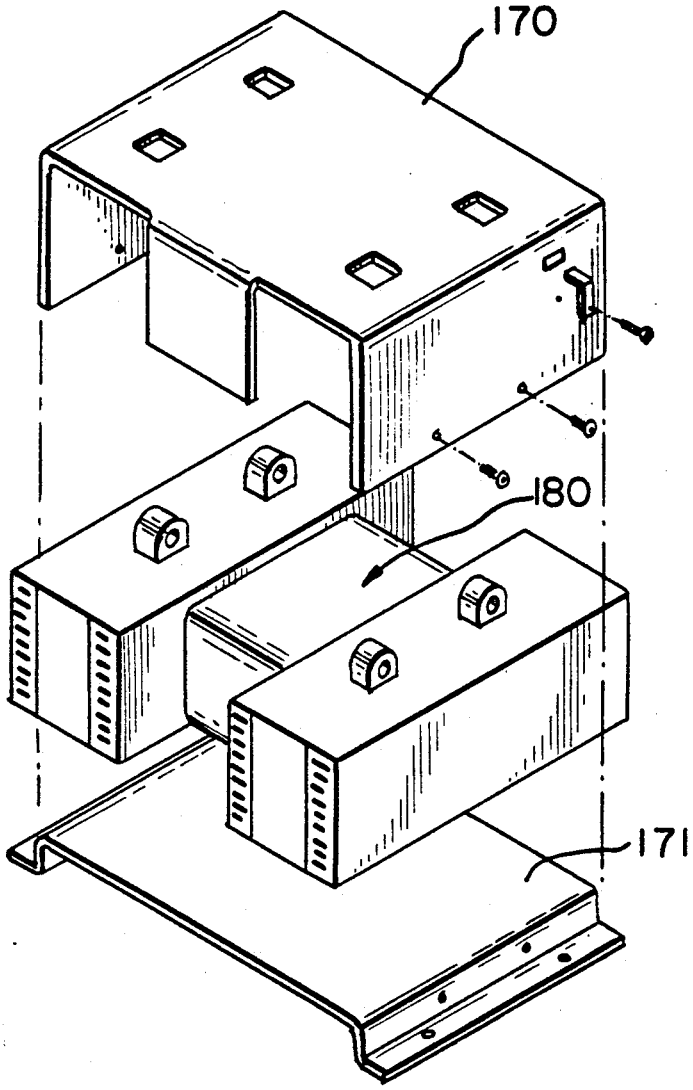
FIG. 9 is an alternate embodiment showing two bussing connectors interconnected in parallel by a jumper connector.

Two ribs 83 are provided on the internal surface of one of the side walls 70, as shown in FIG. 9. The ribs 83 are required as the stall into which these ribs project is somewhat wider than the other stalls in the housing sections. The ribs 83, in effect, reduce the width of the end stalls so that the bus bars 22 can be inserted only when they are in the desired orientation.

Three aligning members 84 extend from each of the housing parts adjacent to the ends of the side walls. Each of these aligning members has a reduced diameter cylindrical end portion 85 which is received in an opening 86 in the other housing part as shown in FIGS. 5 and 6. A central latch ear 88 is provided for cooperation with a fixed latch ear on a mating connector to be described in greater detail herein.

As shown in FIG. 3, each of the rectangular end caps 20 has opposite upper and lower ends 92 and opposite sides 90. Ribs 94 extend from the sides 90 and are received in recesses 91 in the housing parts 16,18 adjacent to the aligning members. A pair of spaced part terminal housings 98 project from the external surface 96 of each end cap and have cavities 100 therein, FIG. 6, which receive the receptacles 54 at the ends of the bus bar.

To assemble the junction box of the disclosed embodiment, the bus bars 22 are all inserted within the defined stalls 77, as shown in FIG. 4. The end caps are then inserted over the opposed contact ends 54. The other half of the junction box can now be installed over the half having contacts already inserted therein. It should be noted that the housing halves are identical with each housing half having posts 82 at one end, and apertures 86 at the opposite end. The housing halves are assembled by placing the posts 84 of one of the halves into the apertures 86 of the opposite half, which causes the opposite posts 84 to extend through the opposite apertures 86. The posts are profiled such that when fully inserted, they extend beyond the front face of the housing halves. The ends of the posts are now heat staked from each side which retains the two housing halves together, retaining the terminal bus bars and end caps together.

As mentioned above and as shown in FIG. 7, a plurality of stalls are defined between the barrier walls 76, and are generally designated at 77, although particular stalls 77 will be referred to specifically with a letter designator, for example, stalls 77*a*–77*h*. As shown in FIG. 7, eight such stalls are defined for an eight-wire system comprising a ground, an isolated ground, two neutrals, and four hot circuits. This allows the user to selectively choose any one of four circuits to prevent any one of the circuits from overloading.

As shown in FIG. 2, a plurality of slots 110 extend between the internal and external surfaces 64,66 of the housing halves 16,18. In particular, one of the slots 110*a* communicates with the stall 77*a*, as shown in FIG. 7, which is dedicated for the ground bus bar. The slot 110*a* also communicates with the receptacle ears 36 or 38. Also, slots 110*b*, 110*c* communicate with neutral bus bars, slots 110*d* communicate with an isolated ground bus bar and slots 110*e*–110*h* communicate with hot bus bars. It should be appreciated from FIG. 7, that the slots 110 are positioned along four lateral positions A–D, where the lateral positions A and C correspond to the position of the receptacle ears 36, while the lateral positions B and D correspond to the position of the receptacle ears 38, and that each slot is aligned with a receptacle ear 36 or 38 along the bus bars. It should also be appreciated that the slots extend inwardly from opposite directions, at laterally staggered positions to communicate with the oppositely directed ears 36 and 38.

With reference now to FIG. 2, the grounding shell 6 of the power distribution unit 2 comprises an upper shell portion 112 and a lower shell portion 114. The upper shell portion 112 comprises an upper wall 116 and side walls 118 and 120, where the upper wall 116 includes apertures 122 profiled to allow the mounting lugs 124 to pass therethrough. The upper shell portion 112 is profiled so as to be slidably received over the bussing connector 4, such that the side walls 118 and 120 cover the recesses 72 on opposite sides of the connector 4. The sidewall 118 further comprises a slot 126 which is aligned with the slot 110*a* of the bussing connector 4, such that the grounding tab 8 is insertable through the slot 126, and into registration with designated receptacle ear 36 or 38 of the dedicated ground bus. Continued insertion of the ground tab 128 positions a head portion 130 in planar abutting engagement against the side wall 118, and a fastener 131 is insertable through an aperture in the head portion and into threaded engagement with a tapped hole 132, thereby commoning the ground bus with the outer shell 112.

The lower shell portion 114 comprises an upper base portion 135 receivable against the lower surface of the bussing connector, and intermediate the side walls 118, 120, to position side edges 136 against the side walls 118, 120 and positioning through holes 138 in alignment with threaded holes 140 for attachment with screws 142. Apertures 144 are provided in the flanges 146 for mounting purposes.

As assembled above, the power distribution unit is capable of receiving and redistributing a power source. As shown in FIG. 6, an electrical connector is shown at 150 having a housing 152 from which a rectangular hood 154 projects, the hood being dimensioned to fit over one of the housing projections 98 on the end caps. Latch ears 156 are provided on the side walls of each housing for cooperation with the previously identified flexible latch ears 88 on the housing parts. The conductors in the cable have tab terminals 158 on their ends which are mounted in cavities 160 in the connector housing. Each terminal has a blade portion 162 which projects into the rectangular hood 154 so that when the connector is coupled with one of the housing enclosures on the end cap, the blade will be moved through one of the slots 100 in the end cap enclosure and be coupled to one of the receptacles 54 of a bus bar. It should be appreciated that each connector 150 includes one terminal 158 for each bus 22, and in the present example, the connectors comprise 8 such terminals. The cavities in each connector have conventional retaining means as shown at 164 for retaining the terminals in the connector housing.

With the connector 150 as described above, the power distribution unit can be used to distribute electrical power. For example, one connector 150 can be electrically interconnected to an incoming power cable which supplies power to the bus connector 2, while other power cables can receive power by interconnection to the unit 2, by way of interconnection to similar connector 150. Thus, as described above, up to four circuits can be distributed three ways from one input of up to four circuits. In an effort to provide further distribution, of up to four circuits, more than one electrical connector 4, may be interconnected leaving more of the electrical ports 10*a*–10*d* free for power distribution.

Figure 8:
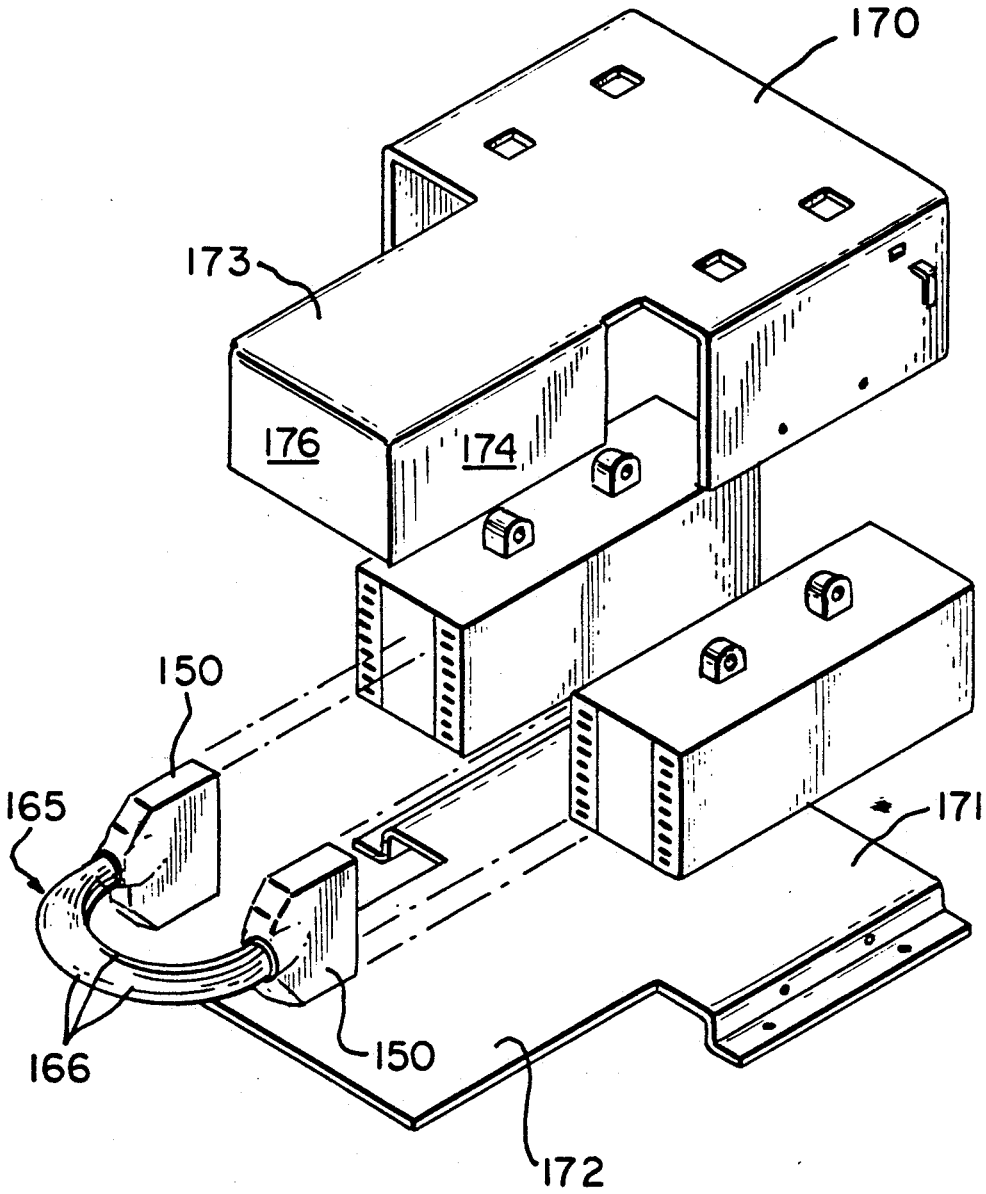
FIG. 8 is a top view showing a first alternate embodiment where two bussing connectors are serially interconnected to increase the output circuits available.

In a first alternate embodiment, as shown in FIG. 8, two bussing connectors are interconnected in parallel by way of a jumper harness 165 interconnected between two of the ports 10. Thus, one of the bussing units could provide for two distribution connectors, while the second bussing connector can provide for three distribution connectors, for a total of five distribution connectors from one input. As shown in FIG. 8, the jumper harness 165 comprises two housings similar in nature to the connector housing 150, where each connector is interconnected at opposite ends of a bundle of insulated conductors 166, in this example, an eight wire bundle.

As shown in FIG. 8, the connector assembly includes an upper cover portion 170, and a lower base portion 171, where both portions 170,171 are comprised of metallic material for grounding purposes. Also, similarly, one of the connectors would include a grounding tab to common the ground bus to the outer metallic cover 170. The upper cover portion includes a front shroud 173 formed by side flap portions 174 and an end flap portion 176. The shroud 173, together with the extended plate section 172 of the base portion 171, enclose the jumper harness 165.

Figure 12:
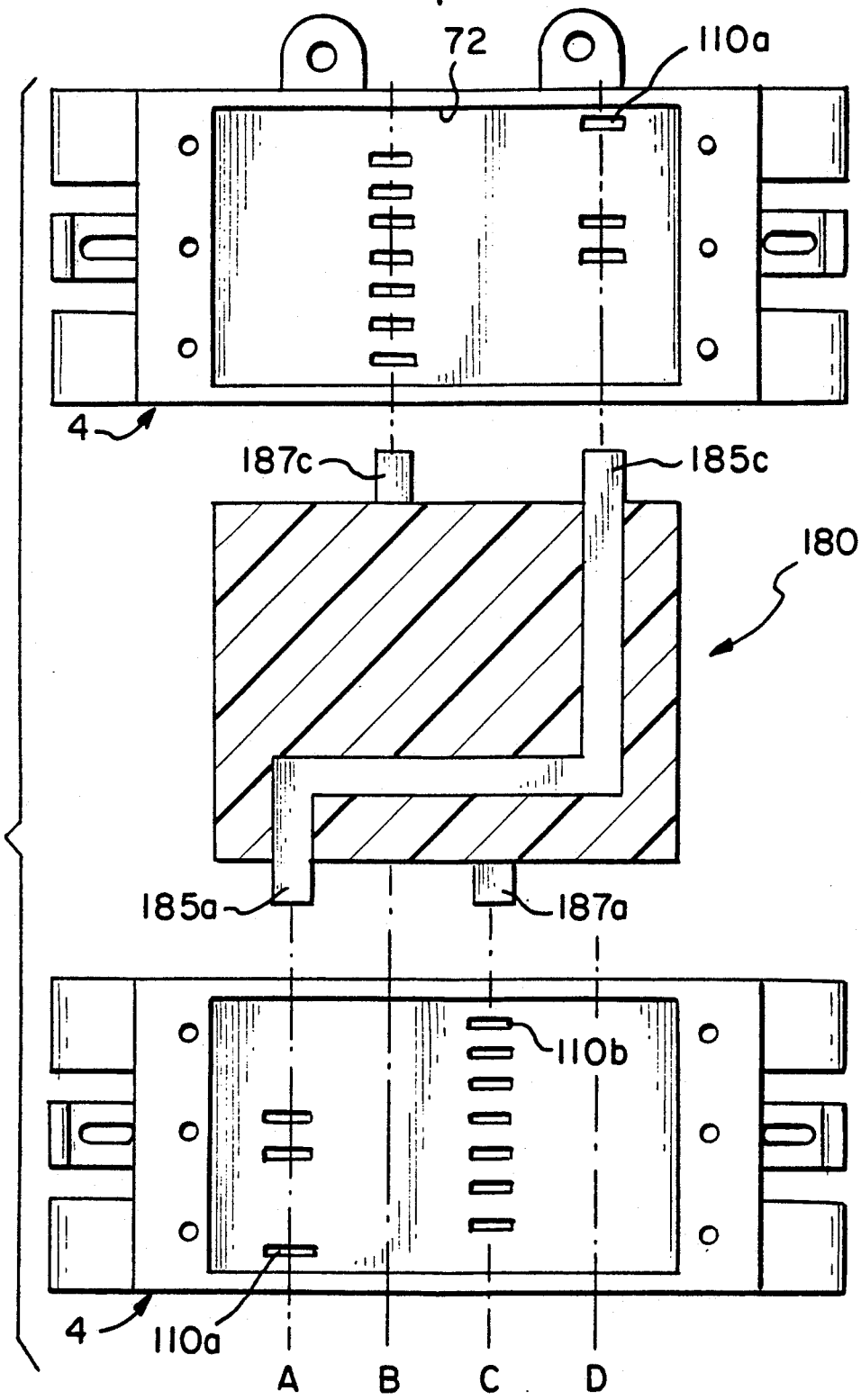
FIG. 12 is a view similar to that of FIG. 10, showing bussing connectors projected above and below the connector.
Figure 17:
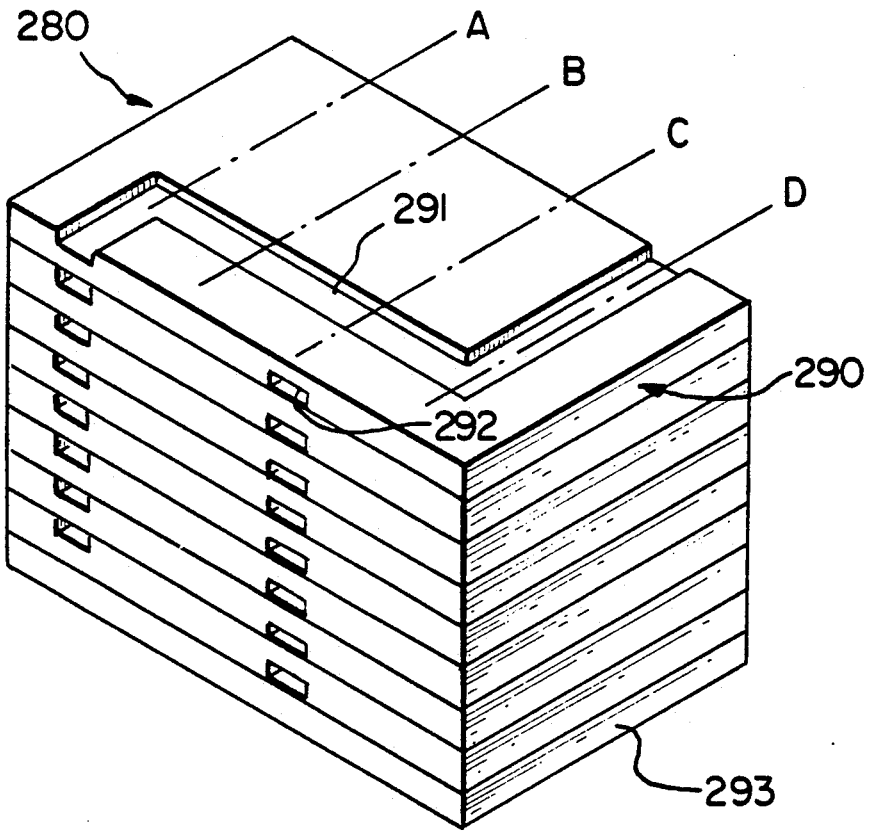

In a further embodiment of the invention, shown in FIG. 9, two bussing connectors 4 can be interconnected in a parallel fashion by way of a connector 180 positioned intermediate two bussing connectors mounted face-to-face. As shown in FIG. 10, the connector 180 comprises an insulating block portion 182 profiled for receipt within facing recesses 72 on two abutting bussed connectors. With reference still to FIG. 10, the connector 180 further comprises electrical terminals 185 and 187, where the terminal 185 comprises a first tab portion 185*a*, continuous with an intermediate portion 185*b*, and further continuous with a tab portion 185*c*. Also, the electrical terminals 187 include first tab portions 187*a*, intermediate portions 187*b* and second tab portions 187*c*. With reference now to FIG. 12, it should be noted that the tab portion 185*a* corresponds to the lateral position A, whereas the tab portion 185*c* corresponds to the lateral position D, and that the tab portion 187*c* corresponds to the lateral portion B, whereas the tab portion 187*a* corresponds to the lateral portion C. This lateral staggering of the terminal tab portions 185*a* to 185*c*, and 187*a* to 187*c*, compensates for the reversal of the slots 110 when two bussing connectors are abutted in a facing manner, thereby commoning like terminals in the two bussing connectors.

With the configuration shown in FIG. 11, seven ports are available for power distribution, ports 10*a*–10*d* on each such bussing connector, with one port required for the power source. This is due to the fact that the tab portions 185*a*, 185*c*, 187*a*, 187*c* are interconnected to the receptacles formed by the ears 36 and 38, rather than interconnecting the two bussing connectors via the receptacles 54.

FIG. 13 shows an alternate embodiment of jumper connector 280 having a plurality of wafers 290 stacked one above the other, where each wafer includes a first recess 291 on an upper surface thereof for jumper terminal 185, and a second recess 292 on a lower surface thereof for a jumper terminal 187. The assembly would also include a flat wafer 293 above and below the assembled wafers 290 thereby electrically insulating the stack. It should be understood that the assembled jumper connector 280 is profiled for receipt within the recess 72.

Figures 14, 15:
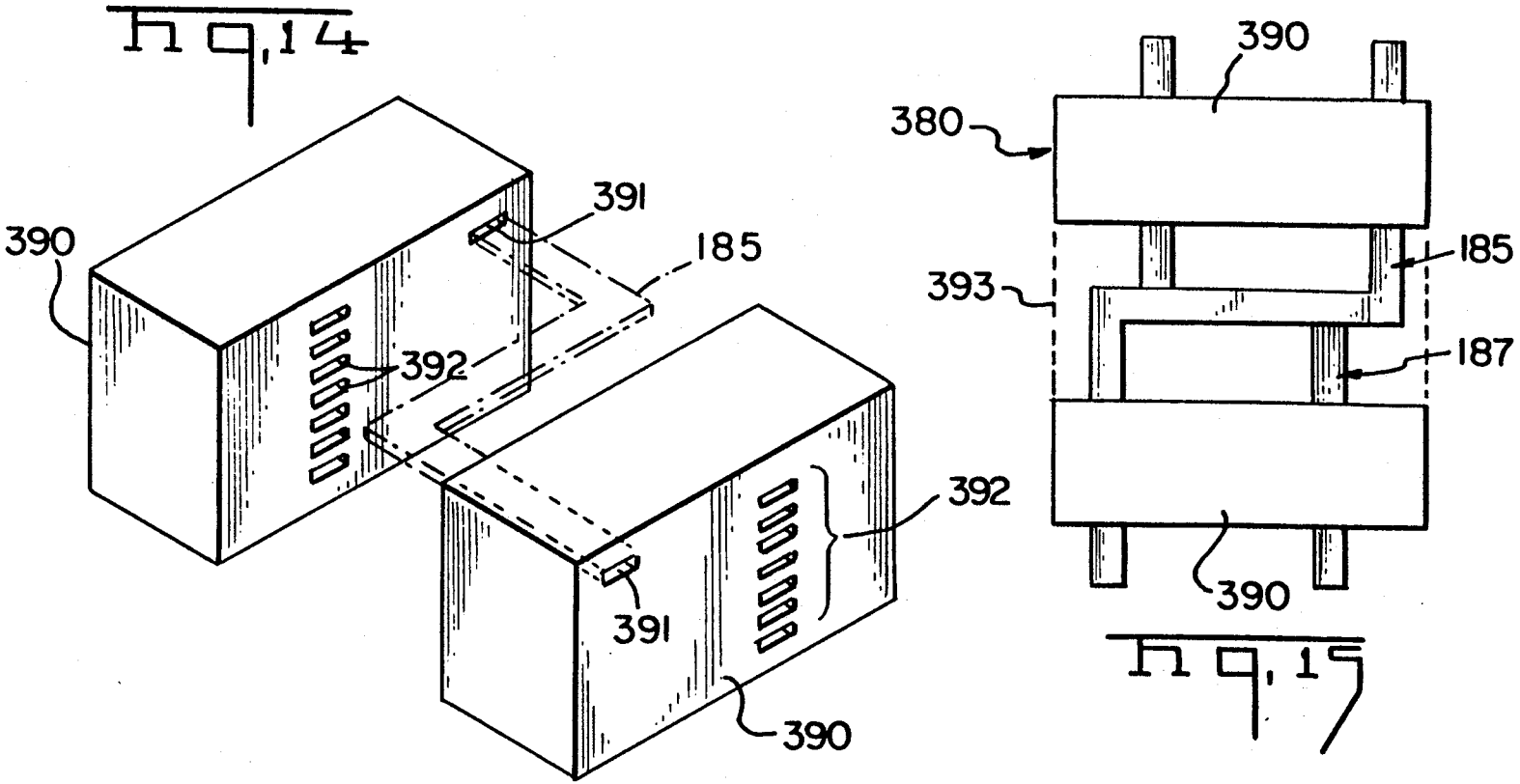
FIGS. 14 and 15 show yet another embodiment of a jumper connector for use with the embodiment of FIG. 9.

Finally, with respect to FIG. 14, another embodiment of jumper connector is shown at 380 comprising connector blocks 390 having apertures 391 and 392. The connector blocks 390 can be so positioned as shown in FIG. 14, to position a jumper terminal 185 through apertures 391, and a jumper terminal 187 through apertures 392. When in the assembled position shown in FIG. 15, the intermediate section 393 can be insulated by way of overmolding or potting material, or other suitable insulating material.

While in the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A power distribution unit comprising:

bussing connection means having insulating housing means having side walls and end walls, where at least one of said end walls comprises through ports and where said member comprises a plurality of internal side-by-side channels, each said channel being in communication with at least two of said through ports, at least one of said side walls including an opening therethrough in communication with one of said channels;

a plurality of electrical power busses positioned in said channels, said busses comprising at least one ground bus, one neutral bus and one hot bus, said ground bus being aligned with said opening in said one channel, said busses being positioned in a stacked array and each comprising a generally flat strip and at least two electrical terminals extending from ends of said busses and insulatively positioned in said at least two through ports for further distribution of power, wherein at least one edge of said ground bus comprises a contact portion folded over about said strip, thereby forming a receptacle portion between said folded over contact and said strip;

metallic grounding shell means at least partially surrounding said housing, leaving said through ports exposed, said metallic grounding shell means comprising a slot therethrough aligned with said opening and said ground terminal; and a grounding tab positioned through said slot and electrically connected to said ground bus and electrically secured to said metallic grounding shell, thereby grounding said ground terminal to said metallic grounding shell means.

2. The power distribution unit of claim 1, wherein said grounding receptacle is positioned facing said opening in said housing means for receipt therein of said grounding tab.

3. A power distribution unit comprising:

bussing connection means having insulating housing means having side walls and end walls, where at least one of said end walls comprises through ports and where said member comprises a plurality of internal side-by-side channels, each said channel being in communication with at least two of said through ports, at least one of said side walls including an opening therethrough in communication with one of said channels;

a plurality of electrical power busses positioned in said channels, said busses comprising at least one ground bus, one neutral bus and one hot bus, said ground bus being aligned with said opening in said one channel, said busses being positioned in a stacked array and each comprising a generally flat strip and at least two electrical terminals extending from ends of said busses and insulatively positioned in said at least two through ports for further distribution of power, wherein said power busses include two integral contacts extending from said flat strips and positioned in said through ports;

a metallic grounding shell means at least partially surrounding said housing, leaving said through ports exposed, said metallic grounding shell means comprising a slot therethrough aligned with said opening and said ground terminal; and a grounding tab positioned through said slot and electrically connected to said ground bus and electrically secured to said metallic grounding shell, thereby grounding said ground terminal to said metallic grounding shell means.

4. The electrical connector of claim 3, wherein each said through port includes one of said two integral contacts from each said power bus.

5. The electrical connector of claim 4, wherein said ports are arranged for mateable interconnecting with an electrical connector, where one electrical connector is provided for input of electrical power and one electrical connector is provided for redistribution of electrical power.

6. The electrical connector of claim 3, wherein said bussing interconnection means comprises two discrete insulative housings, where each said housing has electrical power busses positioned in respective channels, and each said bus within a first insulative housing is electrically connected with an associated bus in a second insulative housing.

7. The electrical connector of claim 6, wherein said power busses are interconnected by commoning said associated busses through said through ports.

8. The power distribution unit of claim 6, wherein each said housing includes a plurality of openings in communication with respective channels and power busses, and said busses in said first insulative housing are interconnected to said busses in said second insulative housing by way of conductive tabs inserted in associated openings of the two said housings.

9. An electrical power distribution assembly comprising:

first and second modular bussing connectors, each bussing connector having insulative support housings and electrical bus terminals positioned therein, comprised of at least one ground bus terminal, one neutral bus terminal and one hot bus terminal, to complete one electrical power circuit, said at least one ground bus terminal being electrically connected to a generally flat strip folded over to form a receptacle terminal, said bussing connectors having a plurality of ports for the access of the bussing terminals for the input or output of a power source, said ports defining an electrical connection access for a mateable connector, said bussing terminals being positioned in said insulative support housing with terminal portions adjacent to each said connection access;

commoning means for interconnecting said bussing terminals together, to increase the number of output ports;

grounding means surrounding said first and second modular bussing connectors; and means for commoning said at least one ground bus terminal to said grounding means comprising a grounding tab electrically connected to said folded over receptacle terminal of said at least one ground bus terminal through one of the access ports and electrically secured to the grounding means.

10. The power distribution assembly of claim 9, wherein said commoning means comprises an electrical cable interconnecting one of said access ports on said first bussing connector to one of said access ports on said second terminals.

11. The power distribution assembly of claim 9, wherein each of said bussing connectors include recesses in a front face thereof, with access openings into said bussing terminals.

12. The power distribution assembly of claim 11, wherein said commoning means comprises a jumper connector positioned at least part way in each said recess, where said jumper connector comprises electrical terminals adapted for receipt with said access openings in said first and second bussing connectors.

13. The power distribution assembly of claim 12 wherein said jumper connector comprises a plurality of wafers stacked one above the other, with said electrical terminals positioned therebetween.

14. The power distribution assembly of claim 9 wherein said grounding means comprises a stamped sheet metal cover substantially enclosing said first and second bussing connectors.

15. An electrical power distribution assembly comprising:

first and second modular bussing connectors, each bussing connector having insulative support housings and electrical bus terminals positioned therein, comprised of at least one ground bus terminal, one neutral terminal and one hot bus terminal, to complete one electrical power circuit, said bussing connectors having a plurality of first ports for the access of the bussing terminals for the input or output of a power source, said ports defining an electrical connection access for a mateable connector, said bussing terminals being positioned in said insulative support housing with terminal portions adjacent to each said connection access, said bussing connectors further comprising a set of second access ports intersecting said bussing terminals;

commoning means connectable with said second access ports on said first and second bussing connectors for interconnecting respective bussing terminals together; and grounding means comprising a stamped sheet metal cover substantially enclosing said first and second bussing connectors.

16. The power distribution assembly of claim 15, wherein each of said bussing connectors include recesses in a front face thereof, with access openings into said bussing terminals.

17. The power distribution assembly of claim 16, wherein said commoning means comprises a jumper connector positioned at least part way in each said recess, where said jumper connector comprises electrical terminals adapted for receipt with said access openings in said first and second bussing connectors.

18. The power distribution assembly of claim 17, wherein said jumper connector comprises a plurality of wafers stacked one above the other, with said electrical terminals positioned therebetween.

* * * * *